US006015203A

United States Patent [19]

Arai et al.

[11] Patent Number: 6,015,203

[45] **Date of Patent: *Jan. 18, 2000**

[54] RUBBING MEMBER FOR INK JET APPARATUS

[75] Inventors: Atsushi Arai, Kawasaki; Hideo Fukazawa, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/005,064

[22] Filed: Jan. 15, 1993

[30] Foreign Application Priority Data

Jan. 20, 1992 [JP] Japan ..... 4-007551

[51] Int. Cl.[7] ..... B41J 2/165

[52] U.S. Cl. ..... 347/33

[58] Field of Search ..... 346/140 R; 347/33, 347/31, 22, 20; 239/106; 15/97.1, 104.16; 101/425; B41J 2/165

[56] References Cited

U.S. PATENT DOCUMENTS

| | | | |
|---|---|---|---|
| 4,306,245 | 12/1981 | Kasugayama et al. | 347/33 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/1.1 |
| 4,608,577 | 8/1986 | Hori | 346/140 R |
| 4,719,475 | 1/1988 | Kiyohara et al. | 346/140 R |
| 4,723,129 | 2/1988 | Endo et al. | 346/1.1 |
| 4,740,796 | 4/1988 | Endo et al. | 347/1.1 |
| 4,829,318 | 5/1989 | Racicot et al. | 346/140 R X |
| 4,928,120 | 5/1990 | Sphrley | 347/33 |
| 5,005,024 | 4/1991 | Takahashi et al. | 346/140 R X |
| 5,113,206 | 5/1992 | Fukazawa | 346/140 R |
| 5,126,765 | 6/1992 | Nakamura | 346/140 R |
| 5,138,344 | 8/1992 | Ujita | 346/140 R |
| 5,182,582 | 1/1993 | Okamura | 346/140 R |
| 5,184,147 | 2/1993 | MacLane et al. | 347/33 |
| 5,206,666 | 4/1993 | Watanabe et al. | 347/33 X |
| 5,266,974 | 11/1993 | Koitabashi et al. | 347/33 |

FOREIGN PATENT DOCUMENTS

| | | | |
|---|---|---|---|
| 0323261 | 7/1989 | European Pat. Off. . | |
| 0418815 | 3/1991 | European Pat. Off. . | |
| 475424 | 3/1992 | European Pat. Off. | B41J 2/165 |
| 54-056847 | 5/1979 | Japan . | |
| 59-123670 | 7/1984 | Japan . | |
| 59-131465 | 7/1984 | Japan . | |
| 59-138461 | 8/1984 | Japan . | |
| 60-071260 | 4/1985 | Japan . | |
| 1-195048 | 8/1989 | Japan | B41J 2/165 |
| 3290261 | 12/1991 | Japan . | |

*Primary Examiner*—Joseph Hartary
*Attorney, Agent, or Firm*—Fitzpatrick, Cella, Harper & Scinto

[57] ABSTRACT

An ink jet recording apparatus includes an ink jet head and a wiping member with an inclined surface. The top portion of the wiping member is closer to the ink jet head than a bottom portion of the wiping member such that the amount of penetration of the wiping member on an ink discharge port surface of the ink jet head varies.

11 Claims, 6 Drawing Sheets

RUBBING MEMBER FOR INK JET APPARATUS

BACKGROUND OF THE INVENTION

1. Field of the Invention

The present invention relates to an ink jet recording apparatus having a member for cleaning the ink deposited onto the surface of an ink jet head for recording by discharging the ink.

2. Related Background Art

In ink jet recording apparatuses for recording with an ink jet head which discharges the ink onto a recording medium, the ink mist produced by the discharging of ink or the ink mist splashed away from ink droplets impinging on the recording sheet may sometimes adhere to an ink discharge port area of the ink jet head or a head surface having discharge ports formed thereon, or alien substances such as paper powders or dirts may deposit thereto via the wet ink, thereby blocking some discharge ports. In such a case, even if the recording is then made, the discharge direction of the ink may vary owing to the effects of adherent matters, causing a discharge failure, or making impossible the discharge to lead to the abnormal recording.

In conventional ink jet recording apparatuses, there is provided a cleaning member (cleaning blade) for wiping the discharge ports a non-recording region, with which adherent matters are cleaned away by rubbing a discharge port formation face against said cleaning member by utilizing the movement of a carriage having the head mounted thereon. This art is important in improving the recording characteristics of the ink jet recording apparatus or enhancing the reliability.

Also, because adherent matters such as paper powders or dirt may not be removed by this cleaning operation, or foreign matters may enter some discharge ports, there is provided a recovery device composed of a suction cap and a suction pump to suck away these contaminants together with the ink through discharge ports due to a negative pressure of the pump.

On the other hand, to control properly the interval (a so-called paper distance) between an ink jet head and the surface of a recording member (recording sheet) in performing the printing is also an important art for maintaining the high-quality image in the ink jet recording apparatus. When the paper distance is too great, the impinging point may be greatly displaced due to deflection in the jetting direction of ink droplet, resulting in conspicuous distortions of the image with lesser image. Conversely, if the paper distance is too close, the recording head may be rubbed against the recording sheet due to deformation (so-called cockling) of the recording sheet after printing, disordering the image, or damaging the recording head to bring about the abnormal discharge, so that a nonconformity such as degraded quality image occurs at times.

In an ink jet recording apparatus which allows for the use of a plurality of kinds of recording sheets, the adjustment of paper distance is particularly important because the paper interval will greatly vary depending on the difference in the thickness of recording sheet, or the degree of cockling.

Thus, in conventional ink jet recording apparatuses, the adjustment of the paper interval relative to the head was conducted by changing automatically or manually the position of a carriage for holding the ink jet head at a multiplicity of stages so as to adjust the paper interval to a proper value.

FIG. 4 shows a perspective view of an ink jet recording apparatus having a wiping member and a suction device and provided with means for changing the position of carriage, and FIG. 5 shows a schematic view of a portion around the carriage and the recovery device.

In FIG. 4, 1 is a recording head, 2 is a carriage, 31 is a carriage guide pipe for supporting the carriage, and 32 is a carriage rail guide for determining the distance between the carriage and a platen by coming into contact with the bottom face of carriage, in which the carriage position can be determined by 31 and 32. Numeral 4 is a platen for supporting the print face of a recording sheet.

Recording means 1 as shown in the figure is one example of color recording means, and the carriage 2 has four recording heads with different color inks mounted thereon. Four ink colors for use are black, cyan, magenta and yellow, for example.

Note that all or any one of four recording heads constituting recording means is indicated by recording means 1 or recording head 1 in the following description.

In FIG. 4, 6 is wiping means (hereinafter referred to as a blade) as a cleaning member for wiping away alien substances by rubbing against a discharge port face of each head, and 51 is capping means for enclosing the head at the time of suction recovery, both of them being held on a recovery base so as to be movable in directions toward and away from the carriage. The capping means 51 held on the recovery base 53 is connected via a suction tube 27 to a suction recovery pump 26. Numeral 7 indicates a carriage position lever.

In such an ink jet recording apparatus with the above constitution, after recording with the ink jet head, or after interruption of the recording, the ink jet head is moved from a recording region to a non-recording region (thereinafter referred to as a home position) where the head is placed opposite to the cap, and stopped therein, and the cap is moved closer to the carriage to make a capping. And after the capping is made, a suction recovery operation is performed by using the suction pump 26. Also, when the carriage is moved to the home position, the wiping member 6 is projected outward in a direction toward a plane containing the ink discharge port of the head (thereinafter referred to as a head face plane) to make a wiping operation by rubbing against the head face plane.

Referring now to FIG. 5, Numerals 1, 31, 32, 51 and 53 in the figure are the same as those in FIG. 4. Numeral 7 is a carriage position lever (hereinafter referred to as a lever), with its lower end portion provided in contact with a carriage guide rail, and the position of the carriage can be determined by means of this contact portion and the carriage guide pipe. Accordingly, the position of the carriage is controllable by changing the position of the lever 7. In FIG. 5, three different lever positions of A, B and C are indicated. In FIG. 5, Numeral 61 is a wiping blade (hereinafter referred to as a blade) composed of an elastic member, 62 is a blade base, 63 is a presser spring for securing the blade 61 to the blade base 62, and 64 is an absorbing body plate arranged close to the blade 61 and for removing the blade adherent ink. The wiping member 6 comprised of 61, 62, 63 and 64 is attached to the side of the recovery base 53 so as to be movable in directions toward and away from the carriage.

In such an ink jet recording apparatus, to control precisely the wiping condition, in particular, the amount of penetration of the wiping member into recording head, it was the common practice to place the recording head at the same position at any time in a region where the wiping was performed. That is, the position of recording head might vary between the print region and the wiping region (normally contained in a recovery operation region).

However, in such an ink jet recording apparatus, in conducting the wiping operation during the printing, the carriage is moved in both the wiping region and the print region, whereby there was a risk of causing such a malfunction that the printed image was distorted or the pressure variation was produced in the ink within an ink supply channel, thereby making the discharge unstable, due to the vibration of the carriage produced by the change of position. Therefore, in the conventional ink jet recording apparatuses, a countermeasure against the malfunction was taken by providing an approach region sufficient to receive the vibration between the wiping region and the print region, or a position changing region to enable the position change gently, but such a provision resulted in a larger main body with a more complex mechanism.

That is, conventionally, in the ink jet recording apparatus having a carriage settable at a plurality of positions, it was difficult to make the main body smaller while maintaining high image quality and high reliability.

The present inventors have found, as a result of minute examinations to solve the above-mentioned problems, that there occurs a difference in the cleaning characteristic depending on the rubbing state between the wiping member and the ink jet head.

SUMMARY OF THE INVENTION

In view of the aforementioned aspects, an object of the present invention is to provide an ink jet recording apparatus capable of exhibiting the excellent wiping performance by optimizing the setting for the amount of penetration of a wiping member into an ink jet head.

Also, it is another object of the invention to provide an ink jet recording apparatus capable of maintaining an excellent wiping characteristic by retaining the amount of penetration in a predetermined range, without regards to the position of the ink jet head.

The present invention has been proposed to accomplish the aforementioned objects, and provides an ink jet recording apparatus having a rubbing member for removing the ink adhering to an ink discharge portion and alien substances by rubbing against said ink discharge portion of ink jet head, characterized in that said rubbing member is disposed obliquely with respect to an ink discharge port formation face of the ink jet head so that the amount of penetration of said rubbing member into said ink jet head may vary depending on the area.

In this way, because the amount of pentration of the rubbing member into the ink jet head is varied depending on the area to accomplish the optimal cleaning state on the discharge face, better wiping performance can be exhibited.

In particular, in an ink jet head capable of taking different recording positions depending on the recording sheet, the apparatus main body can be made smaller while the excellent wiping performance is exhibited, irrespective of the head position, because no special position for the cleaning is provided, so that the high image quality and the high reliability can be maintained.

DETAILED DESCRIPTION OF THE PREFERRED EMBODIMENTS

The embodiments of the present invention will be specifically described below with reference to the drawings, but the present invention contains a variety of constitutions which fall within the scope of the claims, and is not limited to the embodiments as hereinafter described.

First of all, we analyzed the cleaned state on the surface of an ink jet head by a wiping member. Its results are shown in FIGS. 3A to 3C.

Figure 3A:
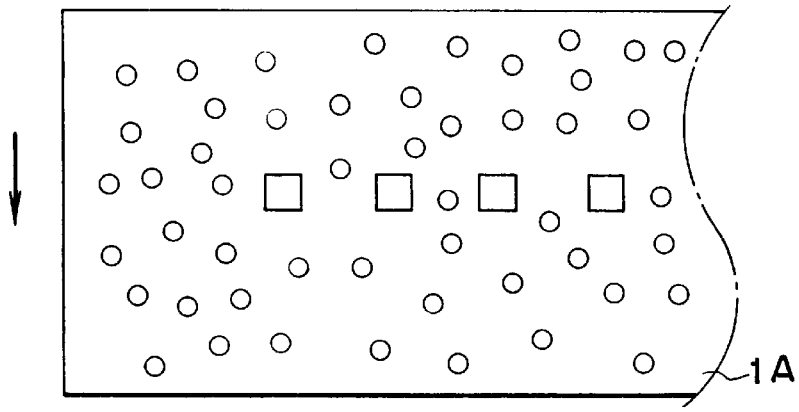
FIGS. 3A to 3C are views schematically illustrating several states of residual ink on the head face plane after the wiping operation with the wiping member, wherein 3A is a state when the amount of penetration of the wiping member is deepest, 3B is a state when it is medium, and 3C is a state when it is shallowest.
Figure 3B:
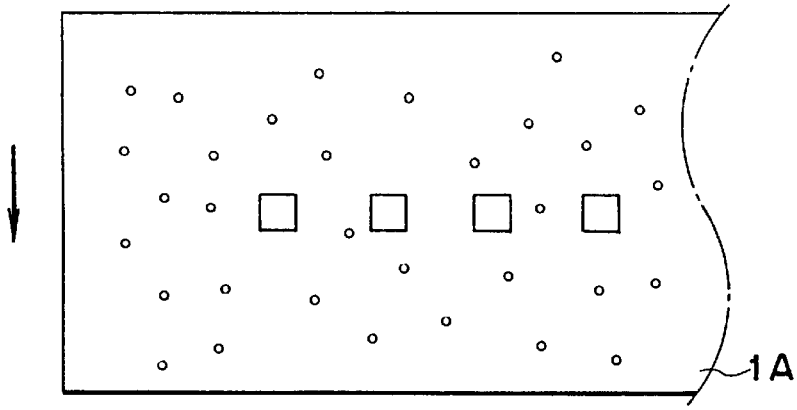
Figure 3C:
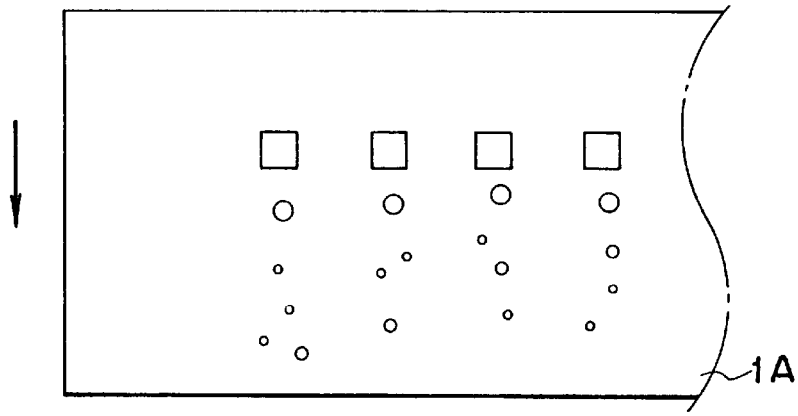
Figure 4:
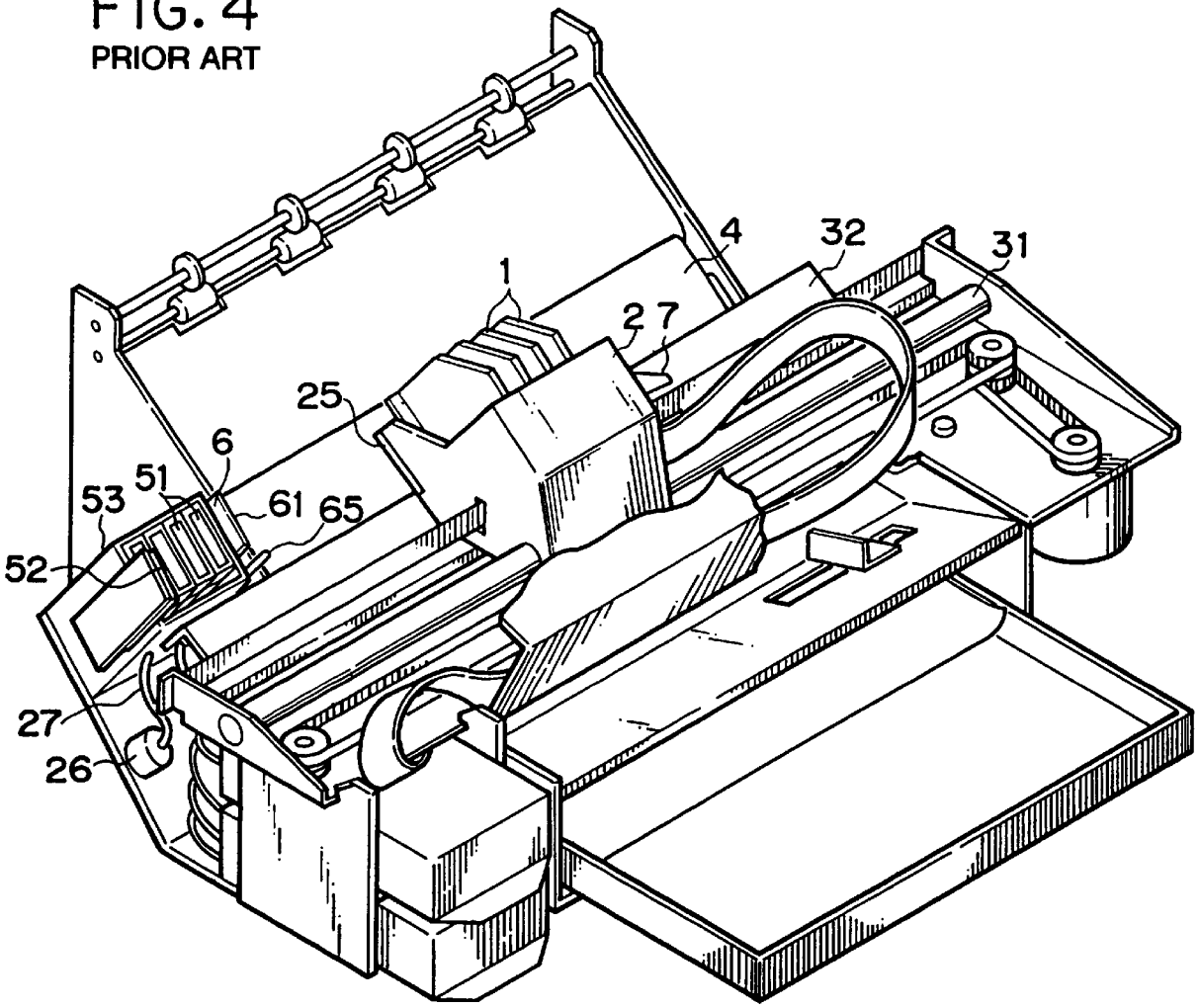
FIG. 4 PRIOR ART
FIG. 4 is a perspective view schematically illustrating a conventional ink jet recording apparatus.
Figure 5:
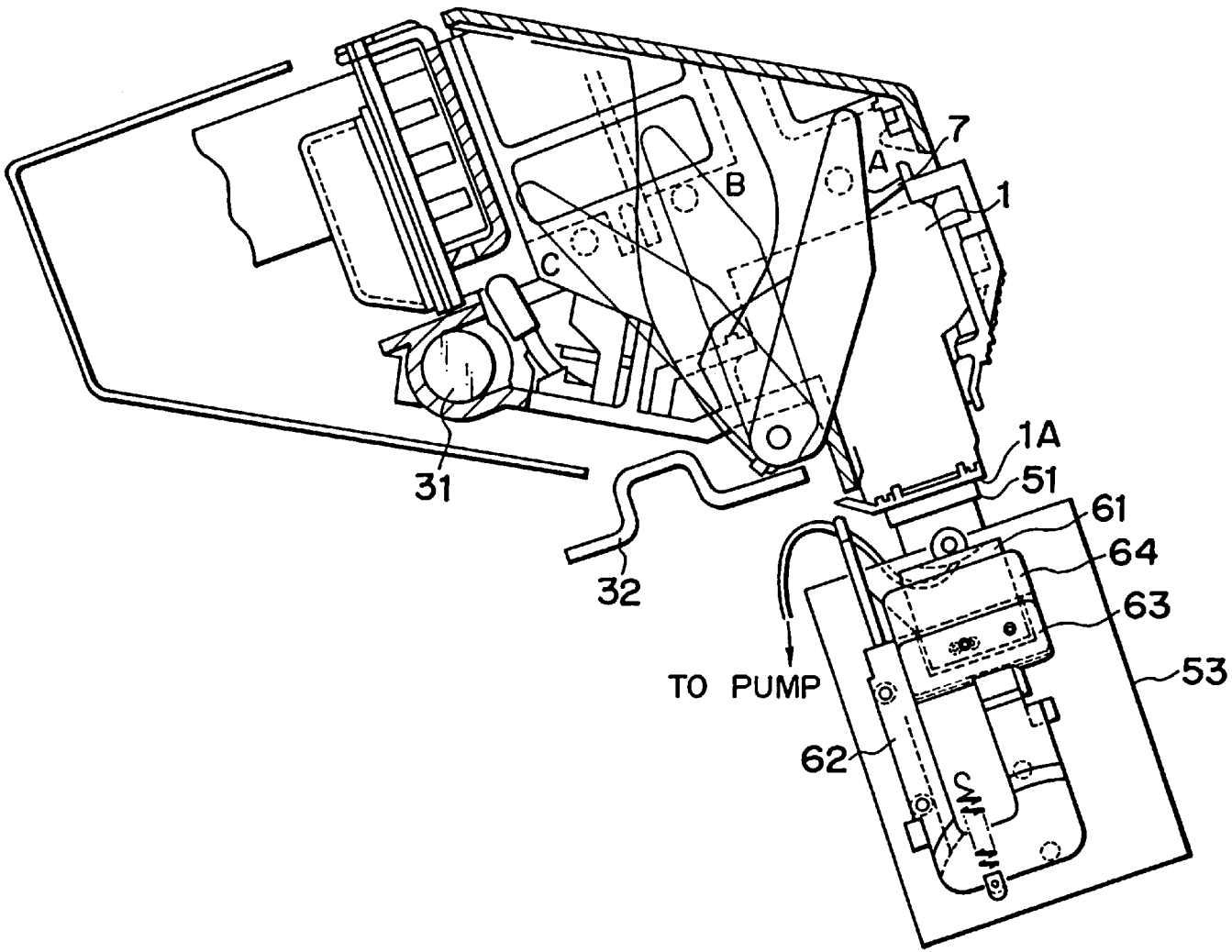
FIG. 5 PRIOR ART
FIG. 5 is a constitutional view schematically illustrating the arrangement relation between a recovery device and the ink jet head of the ink jet recording apparatus as shown in FIG. 4.

FIGS. 3A to 3C illustrate schematically head face planes after the wiping operation, when the amount of penetration of the wiping member into the head is varied, wherein the amount of penetration is smaller in the order of 3A, 3B and 3C.

According to this preliminary analytical experiment of the cleaning state, it has been found that the optimal amount of penetration of the wiping member is different depending on whether the wiping contact plane contains the discharge port or not in a travelling direction of the wiping member.

That is, it can be found that the proper amount of penetration in a plane containing the discharging port and its extension in a cleaning direction of the wiping member is indicated in FIG. 3B where residual ink is the least. Also, it can be found that the proper amount of penetration in a plane not containing the discharge port and its extension in the cleaning direction of the wiping member is indicated in FIG. 3C where there is little residual ink.

In consideration of this results, we have attained a view that when wiping the plane not containing the discharge port and its extension, a greater cleaning effect can be obtained if the amount of penetration is smaller than the proper amount of penetration for wiping the plane containing the discharge port and its extension.

Also, as a result of another experiment in which the print and suction operations are repeated with the ink jet head set at various positions relative to the recording sheet, it has been found that ink droplets adhering to a face plane (discharge port formation face) of the ink jet head, such as ink wetting due to the ink mist during the printing, or the ink remaining after the suction operation will tend to move in a gravitational direction and accumulate in a lower portion.

In view of these results, it is possible to effectively wipe out the ink or dirt adhering to the discharge port formation face by optimally varying the amount of penetration of the wiping member along the gravitational direction of the recording head.

More specifically, where the discharge ports of the recording head are formed as an array along the gravitational direction, when the cleaning is performed by the wiping member crosswise to an array direction, an excellent cleaning state can be attained by gradually reducing the amount of penetration of the wiping member into the ink jet head from upward to downward of the ink jet head in the gravitational direction thereof.

Of course, where the cleaning is made by the wiping member along the array direction of discharge ports, if the amount of penetration of the wiping member into the ink jet head in the cleaning is reduced gradually from upward to downward of the ink jet head in one gravitational direction, the excellent cleaning characteristic can be obtained. In this case, it should be noted that the amount of penetration of the wiping member to clean the discharge port face and the amount of penetration of the wiping member to clean a portion except for the discharge port face are made different, or the amount of penetration for cleaning the discharge port face is made greater than that for cleaning the portion except for the discharge port face, whereby the cleaning characteristic can be further improved.

The specific embodiments to which the present invention is applied will be described below with reference to the drawings.

EMBODIMENT 1

Oblique Setting of Parallel Blade

Figure 1:
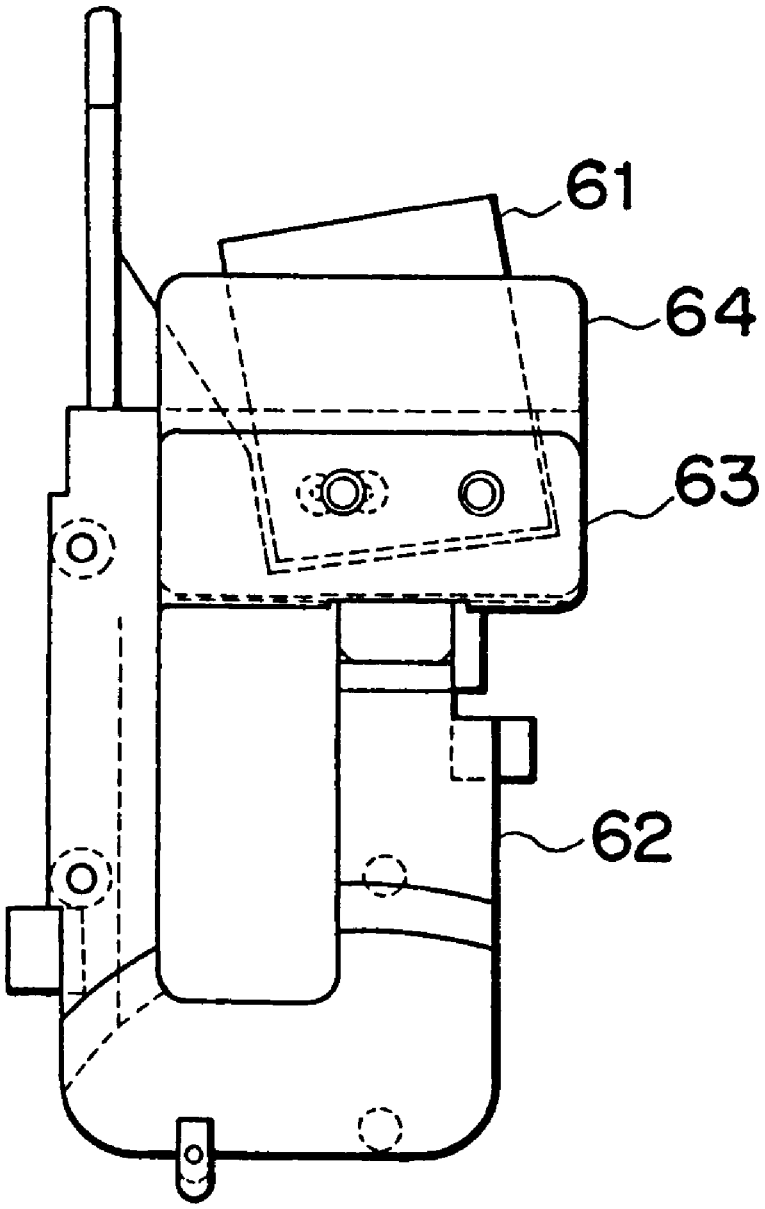
FIG. 1 is a schematic constitutional view of a wiping member according to an embodiment of the present invention.
Figure 2:
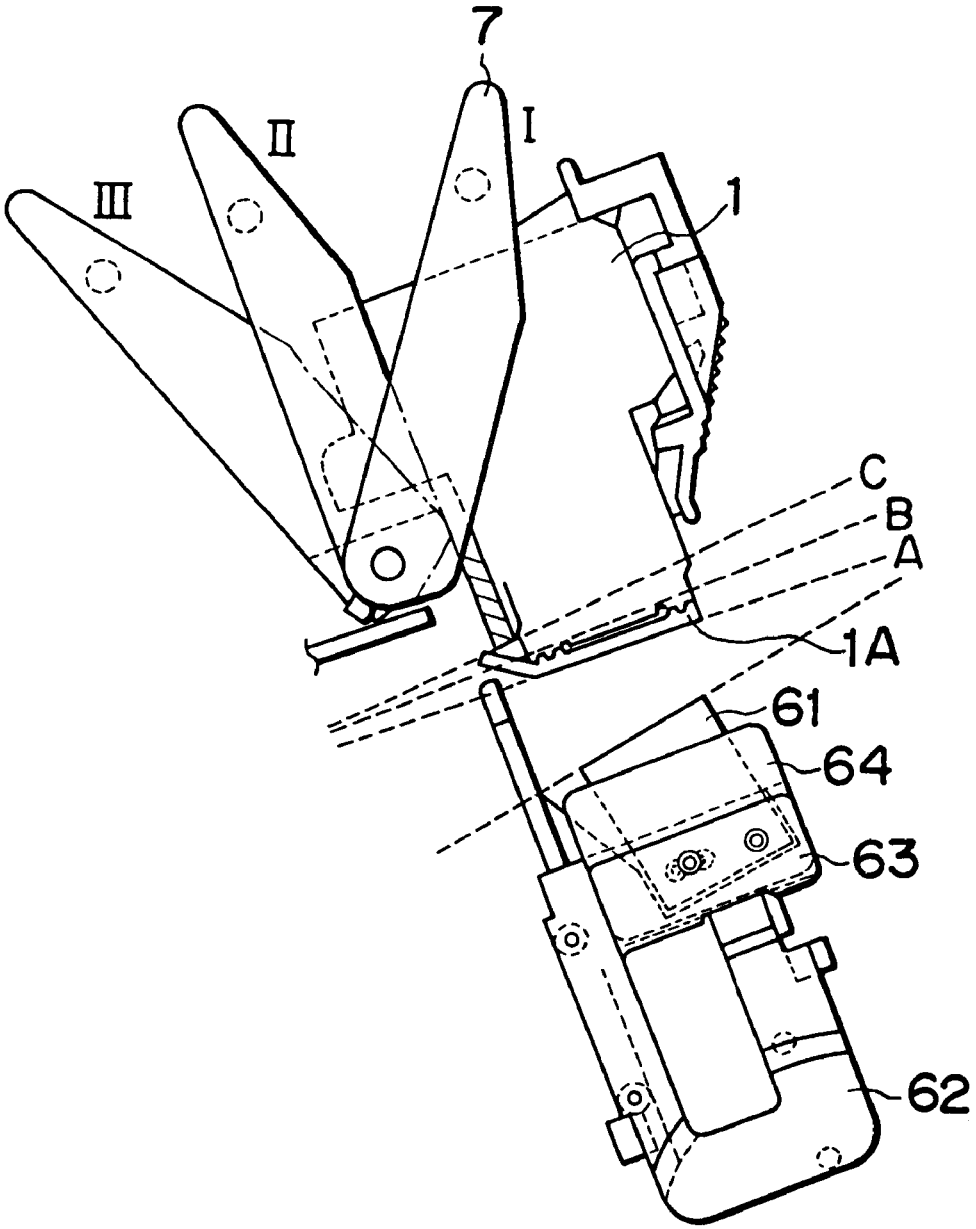
FIG. 2 is a constitutional view schematically illustrating the arrangement relation between the wiping member as shown in FIG. 1 and an ink jet head.

FIG. 1 illustrates a schematic constitution of a wiping member according to a first embodiment of the present invention, and FIG. 2 illustrates schematically the positional relation between a wiping blade and a head.

In FIG. 1, 61 is a blade made of an elastic member, 62 is a blade base, and 63 is a presser spring for securing the blade 61 to the blade base 62, in which the blade 61 is obliquely secured to the blade base 62. The wiping member 6 constituted of 61, 62 and 63 is attached to the side of a recovery base 53 so as to be movable in the directions towards and away from the carriage.

In FIG. 2, the corresponding positions of a head face plane at the lever positions A, B and C are indicated by the broken line.

As can be seen from FIG. 2, the face plane of the ink jet head is progressively spaced further away from the recording sheet when the lever position is set at A, B and C. And the slope of the face plane is raised more with a greater interspace provided. At all these positions, the face plane is inclined at a predetermined angle so that the amount of penetration of the blade 61 into the recording head 1 is always reduced downwardly in a gravitational direction, whereby the stable wiping performance can be exhibited at each position.

In this embodiment, position A of the face plane for the ink jet head is set at about 30 degrees with respect to the horizontal axis. When this position A is referenced, position B is set at +0.48 degree and position C is set at +1 degree with respect to the reference. Also, for all these planes, the wiping blade 61 is set at +2.37 degrees with respect to the reference so that the amount of penetration is gradually reduced downwardly in the gravitational direction.

In addition, the amount of penetration of the wiping blade 61 into the head face plane is set to be 1.81 mm at an upper end portion of the blade 61 and 1.21 mm at a lower end portion thereof with respect to the face plane of the position A which is a reference position. This amount of penetration has a width of ±0.3 mm as a set width. The inclination of the upper and lower end portions of the blade 61 with respect to a vertical axis is set such that the upper end portion is closer to the head side by 0.6±0.2 mm in length than the lower end portion.

By adopting such a constitution, the cleaning characteristic can be maintained excellent only by setting the installation angle of wiping blade at a predetermined value without requiring control of the carriage position at the wiping operation, resulting in the improved recording quality, with a smaller apparatus main body and a lower price.

EMBODIMENT 2

Oblique Cutting of Integral Blade

Figure 6:
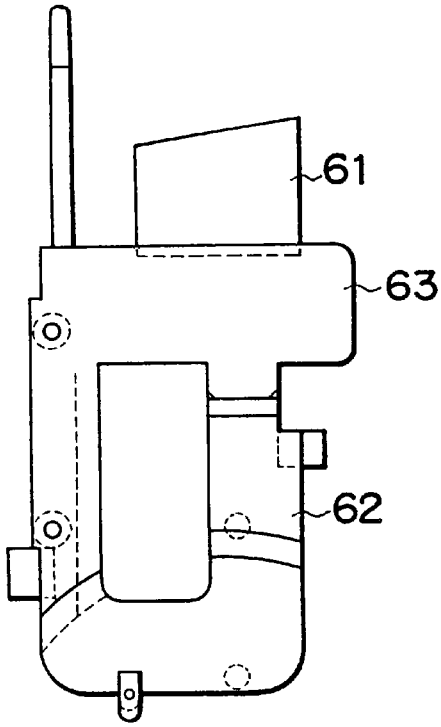
FIG. 6 is a schematic constitutional view of a wiping member according to another embodiment of the present invention.

FIG. 6 is a schematic view of the wiping member according to a second embodiment to which the present invention is applied. In FIG. 6, 61 is a wiping blade moulded integrally with a blade holder 62, with its top end cut obliquely with respect to a holder. Such a wiping member can not only offer the same effects as in embodiment 1, but also allow the easier attachment to the apparatus, and a higher mass productivity so that the wiping member is made at a lower cost, and thus the main apparatus can be marketed at a lower price.

EMBODIMENT 3

Oblique Cutting of Holder

Figure 7:
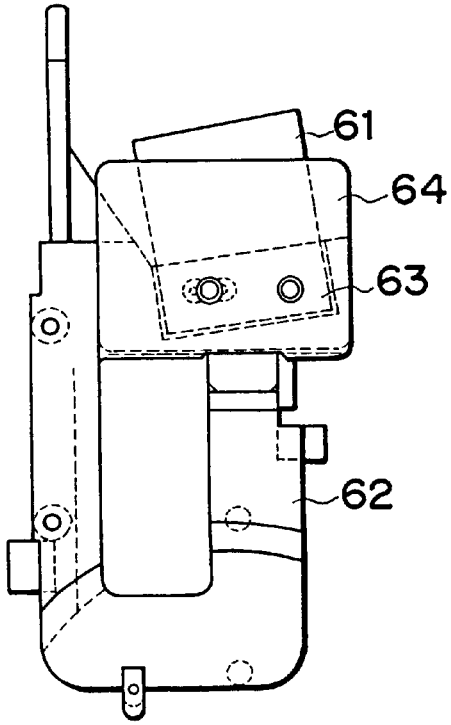
FIG. 7 is a schematic constitutional view of a wiping member according to another embodiment of the present invention.

FIG. 7 is a scheamtic view of a wiping member according to a third embodiment to which the present invention is applied. In FIG. 7, 61 is a blade, 62 is a blade base and 63 is a presser spring. As shown in the figure, this embodiment is the same as the embodiment 1 in that the blade 61 is obliquely secured to the blade base 62, but differs in that the ridgeline at the upper end portion of the blade base is molded in parallel to the upper end portion (wiping portion) of the blade. Such a wiping member can not only offer the same effects as in embodiment 1, but also allow the degree of freedom in setting the blade on the head to increase because of a constant free length of the wiping member to make easier the design of the main apparatus, and provide a higher mass productivity, so that the main device can be marketed at a lower price.

Others

The present invention brings about excellent effects particularly in an ink jet recording head or an ink jet recording device in the method of discharging the ink with the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals.

By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electro-thermal converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention. In addition, the present invention can be also effectively used in the constitution as disclosed in Japanese Laid-Open Patent Application No. 59-123670 which discloses using a slit common to a plurality of electro-thermal converters as the discharging portion of the electro-thermal converter or Japanese Laid-Open Patent Application No. 59-138461 which discloses the constitution having the opening for absorbing pressure wave of heat energy corresponding to the discharging portion.

Further, as the recording head of the full line type having a length corresponding to the maximum width of a recording medium which can be recorded by the recording device, the present invention can effectively exhibit the effects as described above.

In addition, the present invention is effective for a recording head of the freely exchangeable chip type which enables electrical connection to the main device or supply of ink from the main device by being mounted on the main device, or a recording head of the cartridge type with an ink tank integrally provided on the recording head itself.

As the recording mode of the recording device, the present invention is extremely effective for not the recording mode only of a primary color such as black, etc., but also a device equipped with at least a plurality of different colors or full color by color mixing, whether the recording head may be either integrally constituted or combined in plural number.

Though the ink is considered as the liquid in the embodiment as above described, another ink is also useful which is solid below room temperature and will soften or liquify at or above room temperature, or liquefy when a recording enable signal for the ink discharge is issued as it is common with the ink jet device to control the viscosity of ink to be maintained within a certain range of the stable discharge by adjusting the temperature of ink in a range from 30° C. to 70° C. In addition, in order to avoid the temperature elevation due to heat energy by positively utilizing the heat energy for the change of state from solid to liquid, or to prevent the evaporation of ink by using the ink which will stiffen in the shelf state, the use of the ink having a property of liquifying only with the application of heat energy, such as liquifying with the application of heat energy in accordance with a recording signal so that liquid ink is discharged, or may be solidified prior to reaching a recording medium, is also applicable in the present invention. In such a case, the ink may be held as liquid or solid in recesses or through holes of a porous sheet, which is placed opposite to electricity-heat converters, as described in Japanese Laid-Open Patent Application No. 54-56847 or No. 60-71260.

As above described, according to the present invention, the amount of penetration of the wiping member into the recording head is differently given along a gravitational direction of the head surface, so that the wiping characteristic required along the gravitational direction is satisfied, and excellent cleaning can be accomplished.

In particular, the amount of penetration of the wiping member into the recording head is set to be smaller along the gravitational direction of the head surface, so that ink droplets falling down along the gravitational direction can be wiped out effectively.

Also, when setting the position of the recording head in accordance with the recording sheet to be used, the amount of penetration is set to be smaller along the gravitational direction of the head surface at any of the positions, so that it is possible to constitute an ink jet recording apparatus which can exhibit an excellent wiping performance, irrespective of the difference in the carriage position.

Hence, it is possible to provide an ink jet recording apparatus which is smaller in size while maintaining the high image quality and the high reliability.

What is claimed is:

1. An ink jet recording apparatus for use with an ink jet head having an array of a plurality of ink discharge ports defined by an ink discharge port surface, said apparatus comprising:

a rubbing member for rubbing said ink discharge port surface, said rubbing member having a rubbing edge provided substantially parallel to said array, said rubbing edge having an upper portion and a lower portion, wherein overlap of said upper portion of said rubbing edge onto said ink discharge port surface is greater than overlap of said lower portion of said rubbing edge on said ink discharge port surface.

2. An ink jet recording apparatus according to claim 1, wherein said rubbing member is a plate-like member having water repellency and a width for rubbing at least an array region of a plurality of discharge ports in said ink jet head.

3. An ink jet recording apparatus according to claim 1, wherein the ink jet head discharges the ink using heat energy and has electro-thermal convertors for generating the heat energy.

4. An ink jet recording apparatus for use with an ink jet head having an array of a plurality of ink discharge ports defined by an ink discharge port surface having an upper portion and a lower portion, said apparatus comprising:

a rubbing member for rubbing said ink discharge port surface, said rubbing member having a rubbing edge provided substantially parallel to said array so that an amount of penetration of said rubbing edge on said ink discharge port surface varies from said upper portion to said lower portion; and adjustable mounting means for mounting said ink jet head in a plurality of recording positions at various spacings from the recording medium, and at any one of the recording positions an amount of overlap of said rubbing edge on said ink discharge port surface gradually decreases from said upper portion of said ink discharge port surface to said lower portion thereof in a direction of gravity.

5. An ink jet recording apparatus according to claim 1, wherein the ink jet head discharges the ink using heat energy and has electro-thermal convertors for generating the heat energy.

6. An ink jet apparatus for use with an ink jet head having an array of a plurality of ink discharge ports defined by an ink discharge port surface, said apparatus comprising:

a rubbing member for rubbing said ink discharge port surface, a rubbing edge of said rubbing member being provided substantially parallel to said array, said rubbing edge including an upper rubbing portion and a lower rubbing portion with respect to said ink discharge port surface, said upper rubbing portion being closer to said ink discharge port surface than said lower rubbing portion of said rubbing edge to apply a greater amount of overlap to an upper portion of said ink discharge port surface.

7. An ink jet apparatus according to claim 6, further comprising adjustable mounting means for mounting said ink jet head in a plurality of recording positions at various spacings from the recording medium, and at any one of the recording positions an amount of overlap of said rubbing member onto said ink discharge port surface gradually decreases from an upper portion of said ink discharge port surface to a lower portion thereof in a direction of gravity.

8. An ink jet apparatus according to claim 6, wherein the ink jet head discharges the ink using heat energy and has electro-thermal convertors for generating the heat energy.

9. An ink jet recording apparatus for use with an ink jet head having an array of a plurality of ink discharge ports defined by an ink discharge port surface, said apparatus comprising:

a rubbing member for rubbing said ink discharge port surface, said rubbing member having a rubbing edge provided substantially parallel with said array so that an amount of overlap of said rubbing edge on said ink discharge port surface is different from one portion of said rubbing edge to another portion of said rubbing edge.

10. An ink jet recording apparatus according to claim 9, wherein the ink jet head discharges the ink using heat energy and has electro-thermal convertors for generating the heat energy.

11. An ink jet recording apparatus for use with an ink jet head having an array of a plurality of ink discharge ports defined by an ink discharge port surface, said apparatus comprising:

a rubbing member for rubbing said ink discharge port surface, said rubbing member having a rubbing edge inclined relative to said ink discharge port surface so that an amount of overlap of said rubbing edge on said ink discharge port surface is different from one portion of said rubbing edge to another portion of said rubbing edge.

* * * * *

UNITED STATES PATENT AND TRADEMARK OFFICE

CERTIFICATE OF CORRECTION

PATENT NO. : 6,015,203

DATED : January 18, 2000

INVENTOR(S) : Atsushi Arai, et al.

It is certified that error appears in the above-identified patent and that said Letters Patent is hereby corrected as shown below:

ON THE COVER PAGE

Under "References Cited, Foreign Patent Document", change "3290261 12/1991 Japan" to --3-290261 12/1991 Japan--.

COLUMN 1

Line 26, change "a" to --in a--;
line 48, "image." to --image quality.--

COLUMN 3

Line 13, change "change" to --to change--;
line 36, change "regards" to --regard--; and
line 48, change "pentration" to --penetration--.

COLUMN 4

Line 48, change "this" to --these--.

COLUMN 6

Line 31, change "scheamatic" to --schematic--.

UNITED STATES PATENT AND TRADEMARK OFFICE

CERTIFICATE OF CORRECTION

PATENT NO. : 6,015,203

DATED : January 18, 2000

INVENTOR(S) : Atsushi Arai, et al.

It is certified that error appears in the above-identified patent and that said Letters Patent is hereby corrected as shown below:

COLUMN 7

Line 42, change "not" to --not only--; and
line 43, delete "only".

COLUMN 8

Line 64, change "claim 1," to --claim 4,--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*